US007363674B2

(12) United States Patent
Marshall

(10) Patent No.: US 7,363,674 B2
(45) Date of Patent: Apr. 29, 2008

(54) FAN BLADE CLEANING TOOL AND METHOD

(76) Inventor: John C. Marshall, 6249 Thibodeaux Rd., Greenwell Springs, LA (US) 70739

( * ) Notice: Subject to any disclaimer, the term of this patent is extended or adjusted under 35 U.S.C. 154(b) by 736 days.

(21) Appl. No.: 10/718,690

(22) Filed: Nov. 24, 2003

(65) Prior Publication Data

US 2005/0108840 A1 May 26, 2005

(51) Int. Cl.
*A47L 13/17* (2006.01)
*A47L 13/38* (2006.01)

(52) U.S. Cl. ..... 15/104.94; 15/210.1; 15/244.1

(58) Field of Classification Search ..... 15/104.94, 15/210.1, 218.1, 220.4, 244.1, 257.3, 220.3, 15/248.1, 248.2, 221
See application file for complete search history.

(56) References Cited

U.S. PATENT DOCUMENTS 2,788,537 A 4/1957 Greenberg
2,896,243 A * 7/1959 Schoenfield et al. ..... 15/244.2
3,110,923 A * 11/1963 Berleme ..... 15/394
D296,022 S * 5/1988 Restivo ..... D32/51
4,823,431 A 4/1989 Carpenter
4,827,556 A 5/1989 Corsetti
4,841,592 A * 6/1989 Restivo ..... 15/210.1
5,116,151 A * 5/1992 Lytton et al. ..... 401/9
5,235,722 A * 8/1993 Harris et al. ..... 15/394
D341,452 S 11/1993 Songer
5,319,821 A * 6/1994 Nicholson et al. ..... 15/104.8
5,337,445 A 8/1994 Harris et al.
5,359,751 A * 11/1994 Bellardini ..... 15/394
5,369,836 A 12/1994 Horne
5,400,468 A 3/1995 De Petra
5,410,776 A * 5/1995 Schneider ..... 15/398
5,488,754 A 2/1996 Shadley
5,765,259 A * 6/1998 Cika ..... 15/394
6,022,192 A * 2/2000 DeLaHoz et al. ..... 416/146 R
6,345,409 B1 * 2/2002 LaCroix ..... 15/394
6,782,579 B1 * 8/2004 Grimm ..... 15/246

* cited by examiner

*Primary Examiner*—Randall Chin
(74) *Attorney, Agent, or Firm*—Berenato, White & Stavish

(57) ABSTRACT

The present invention is directed to a fan blade cleaning tool having a box-shaped housing. The housing has first and second openings on opposing sides, with a passage extending therebetween for receiving a fan blade. A dust gutter extends outwardly from, and adjacent to, the first opening. A method of cleaning a fan blade using the disclosed tool is also provided.

25 Claims, 4 Drawing Sheets

FAN BLADE CLEANING TOOL AND METHOD

FIELD OF THE INVENTION

The present invention is directed to a fan blade cleaning tool having a box-shaped housing. The housing has first and second openings on opposing sides, with a passage extending therebetween for receiving a fan blade. A dust gutter extends outwardly from, and adjacent to, the first opening. A method of cleaning a fan blade using the disclosed tool is also provided.

BACKGROUND OF THE INVENTION

Various designs for fan blade cleaning tools have been developed. Some conventional designs include a cleaning head having a tubular cleaning cloth secured between two prongs. The cleaning head is attached to a handle. Other designs include an arm extending perpendicularly from one end of the handle, with a cleaning cloth or brush secured to the arm. Such designs are difficult to maneuver onto or around the fan blade, and often fail to adequately clean the fan blade.

Other designs include a housing structure having a passage through which a fan blade is passed. Brushes are provided within the housing for cleaning the blade. Unfortunately, the brushes often push debris and dust from the fan blade surface onto the floor below. In addition, such designs typically include a relatively narrow passage opening. As such, it is often difficult to maneuver the fan blade into the passage.

Other designs have been developed for use with a vacuum cleaner. However, such designs are overly complex, and require a user to lug the vacuum cleaner around when cleaning fan blades. In addition, the vacuum cleaner must be equipped with the appropriate length of tubing for attaching the cleaning apparatus.

SUMMARY OF THE INVENTION

The present invention is directed to a fan blade cleaning tool having a box-shaped housing. The housing has first and second openings on opposing sides, with a passage extending therebetween for receiving a fan blade. A dust gutter extends outwardly from, and adjacent to, the first opening.

A method of cleaning a fan blade is also disclosed. A fan blade is passed through a passage extending through a box shaped housing. Opposing major surfaces of the fan blade are simultaneously cleaned while passing the blade through the passage. Debris is collected from the opposing major surfaces of the fan blade in a dust gutter.

DETAILED DESCRIPTION OF THE INVENTION

Figure 1:
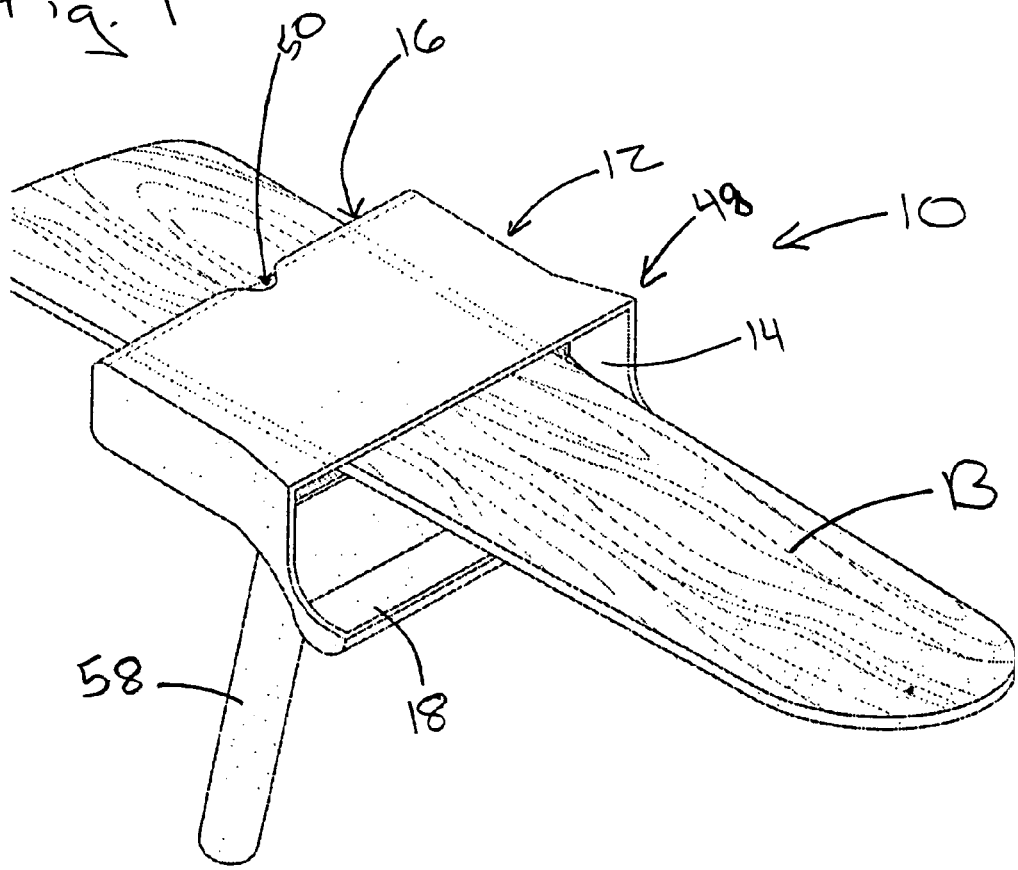
FIG. 1 is a perspective view of a fan blade cleaning tool according to a first embodiment of the present invention, with a fan blade positioned within a housing of the tool.

As best shown in FIG. 1, a fan blade cleaning tool 10 according to a first embodiment comprises a box-shaped housing having first and second openings 14, 16 on opposing sides with a passage extending therebetween for receiving a fan blade B. A dust gutter 18 extends outwardly from, and adjacent to, first opening 14.

Figure 2:
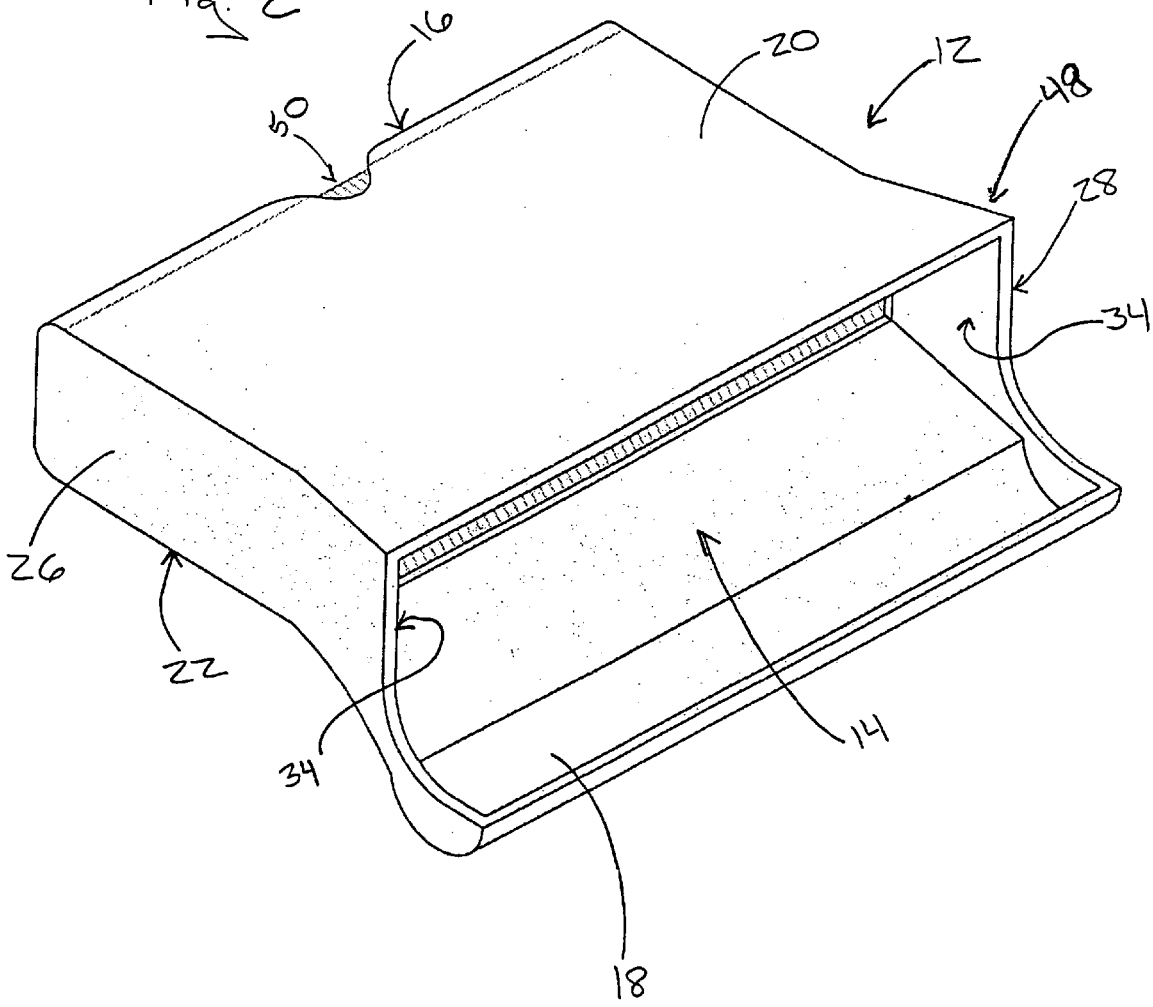
FIG. 2 is a perspective view of the housing of the cleaning tool according to the first embodiment.
Figure 3:
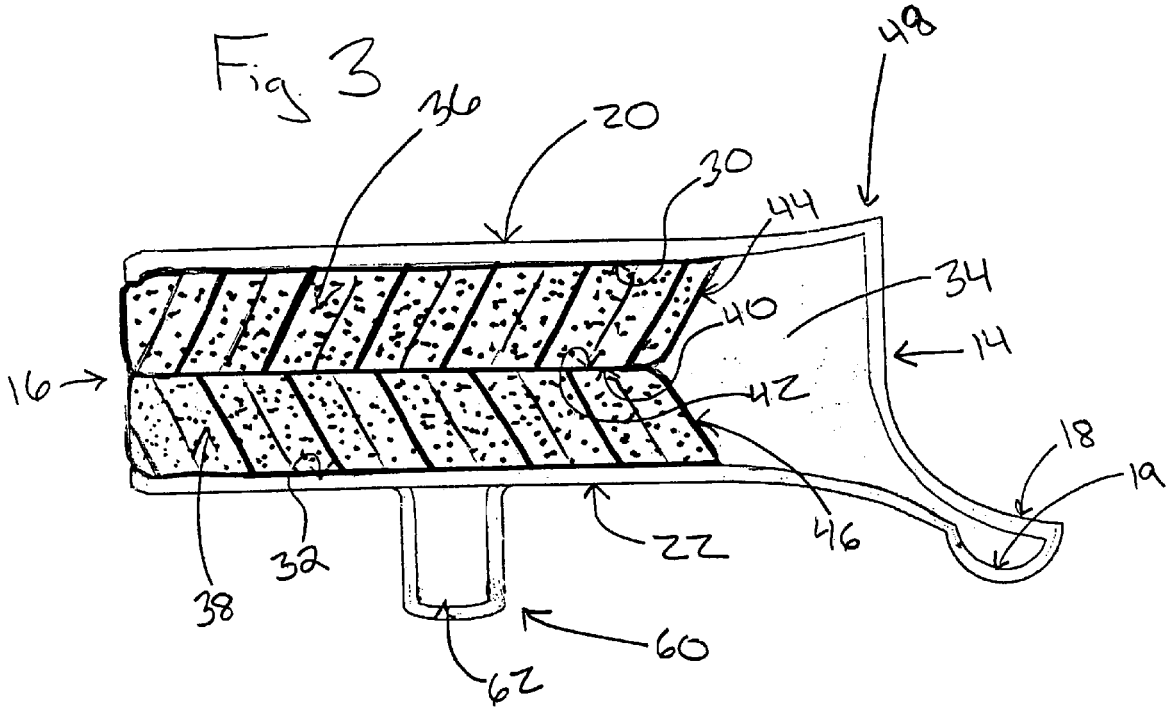
FIG. 3 is a cross-sectional view of the cleaning tool according to the first embodiment.

As best shown in FIGS. 2 and 3, housing 12 comprises a first major planar surface 20 spaced from a second major planar surface 22. Sidewalls 26, 28 extend between first and second major surfaces 20, 22. Sidewalls 26, 28 may be substantially perpendicular to first and second major surfaces 20, 22. Opposing first and second inner surfaces 30, 32, and inner sidewalls 34, define the passage extending between first and second openings 14, 16. Dust gutter 18 extends outwardly from second major surface 22. Housing 12 and dust gutter 18 may be integrally formed of plastic.

Cleaning tool 10 may also include first and second cleaning pads 36, 38, as best shown in FIG. 3. Pads 36, 38 may be formed from foam, or some other sponge-like material that is resiliently deformable. Pads 36, 38 are removably securable within the passage. First pad 36 is adjacent first inner surface 30, and second pad 38 is adjacent second inner surface 32.

First and second pads 36, 38 may be easily pushed into place within the passage, and form a fit within the passage so that the passage is completely blocked by pads 36, 38. However, a fan blade B may be pushed through the passage, as best shown in FIG. 1. Pads 36, 38 deform to allow the fan blade B to pass through the passage. Cleaning surfaces 40, 42 of pads 36, 38, respectively, are in contact with opposing sides of the fan blade B. Pads 36, 38 provide sufficient force against the fan blade B to push any debris and dust off of the opposing blade surfaces. Some of the debris is retained by pads 36, 38. Any excess debris that is not retained by pads 36, 38 is pushed into dust gutter 18 as cleaning tool 10 is pulled away from the fan blade B, as best shown by arrows A in FIG. 4. Opposing sides of the fan blade B are simultaneously cleaned by pads 36, 38. Dust and debris is collected by pads 36, 38 and dust gutter 18, thereby minimizing the possibility of debris falling to the floor below when cleaning fan blade B. As best shown in FIG. 3, dust gutter 18 may lie on a plane spaced from second major planar surface 22, so that dust gutter 18 is below second major planar surface 22 when cleaning tool 10 is being used to clean a ceiling fan blade B. Dust gutter 18 may include a curved base 19, which is relatively easy for a user to wipe clean after use.

Preferably, first and second pads 36, 38 include beveled leading edges 44, 46, which are proximate first opening 14, as best shown in FIG. 3. Beveled leading edges 44, 46 help to direct the fan blade B into position between cleaning surfaces 40, 42 and through the passage. Pads 36, 38 may have substantially identical dimensions. In this way, manufacturing considerations are simplified. In addition, installation and replacement for a user is simplified. Pads 36, 38 may be moistened with a cleaning fluid for additional cleaning power. Pads 36, 38 may also be moistened with a polishing fluid, so that the fan blade B is simultaneously cleaned and polished as it passes between cleaning surfaces 40, 42.

Housing 12 may include a flared end 48, wherein first and second major planar surfaces 20, 22 and sidewalls 26, 28 flare outwardly toward first opening 14, as best shown in FIGS. 1-5. In this way, first opening 14 is larger than second opening 16. Flared end 48 helps to direct the fan blade B into first opening 14. Thus, flared end 48 and beveled leading edges 44, 46 direct the fan blade B through the passage of housing 12.

As best shown in FIGS. 1-2 and 4-5, housing 12 may also include indented portions 50, 52 extending inwardly along edges 54, 56 of first and second major planar surfaces 20, 22, proximate second opening 16. Indented portions 50, 52 extend into first and second major planar surfaces 20, 22, so that portions of pads 36, 38 that are adjacent first and second inner surfaces 30, 32 of housing 12 are exposed. Indented portions 50, 52 extend inwardly from edges 54, 56 a sufficient amount to allow a user to grasp pads 36, 38 with two fingers. Pads 36, 38 may be easily grasped in the exposed portions of pads 36, 38, pinched between two fingers, and removed for replacement.

Figure 4:
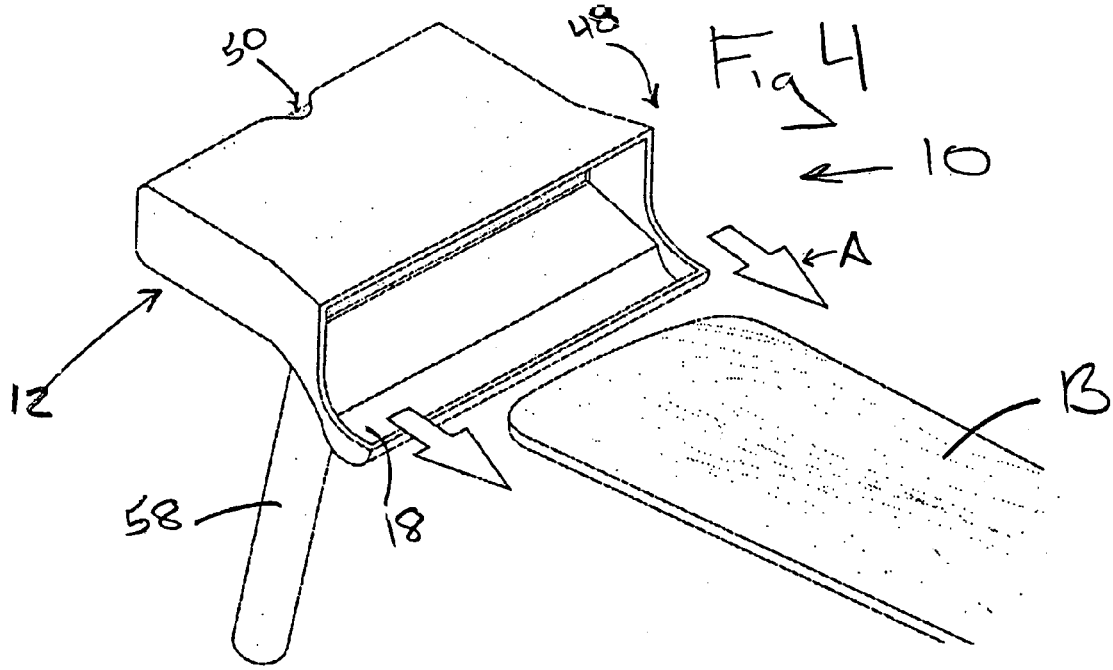
FIG. 4 is a perspective view of the cleaning tool according to the first embodiment, with a fan blade proximate the housing.
Figure 5:
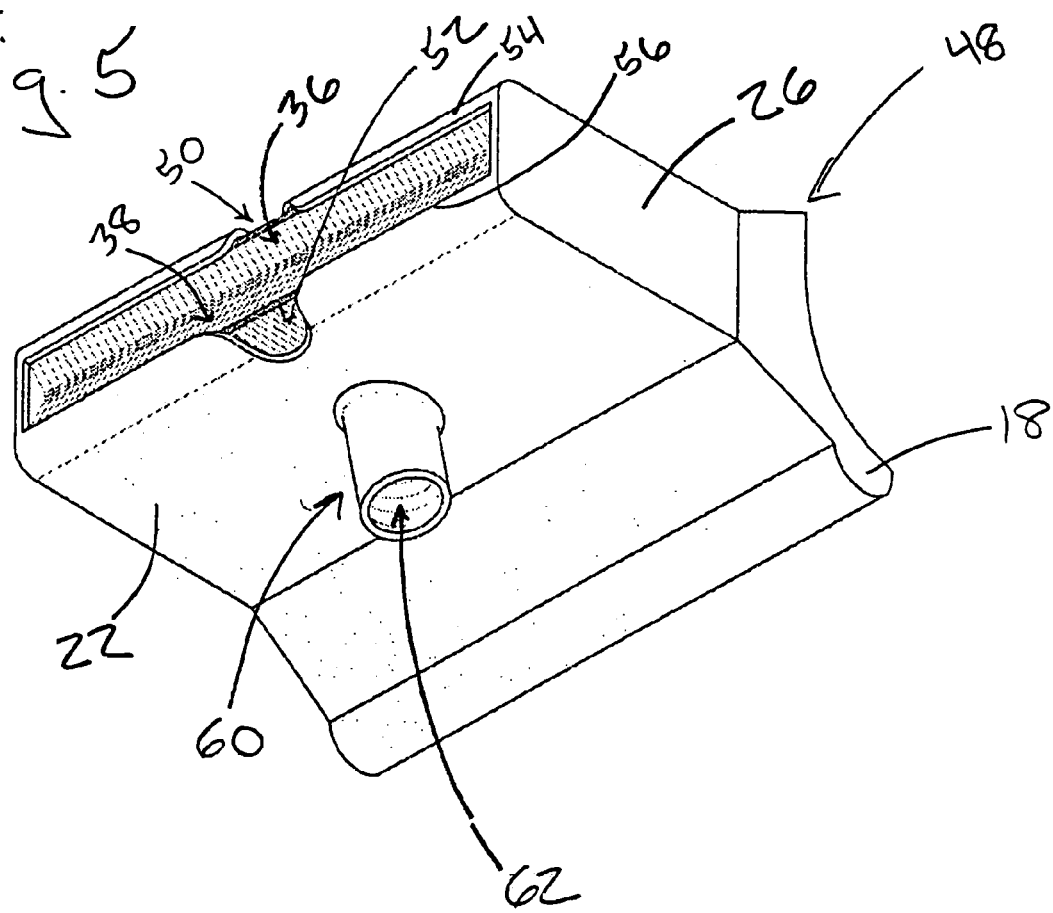
FIG. 5 is another perspective view of the cleaning tool according to the first embodiment.

Cleaning tool 10 may also include a handle 58 extending from housing 12, as best shown in FIGS. 1 and 4. In one embodiment, a tubular member 60 extends Outwardly from second major surface 22, as best shown in FIGS. 3 and 5. Tubular member 60 includes an opening 62 and passage for receiving a conventional broom handle, or similar elongate handle. The passage may extend substantially perpendicular to second major surface 22, so that the handle will extend outwardly from, and substantially perpendicular to, second major surface 22. The passage may be threaded, so that a conventional broom handle may be screwed into the passage. Alternatively, a pin may be screwed through tubular member 60 and into a handle positioned within the passage. The handle may be releasably securable within the passage of tubular member 50.

Certain aspects of the present invention have been explained according to embodiments of the present invention. It will be apparent to one of ordinary skill in the art that various modifications can be made in construction or configuration of the present invention without departing from the scope or spirit of the invention. Therefore, it is intended that the present invention include all such modifications and variations, provided they come within the scope of the following claims and their equivalents.

I claim as follows:

1. A fan blade cleaning tool, comprising:

a box-shaped housing having first and second openings on opposing sides and a passage extending therebetween for receiving a fan blade, said first opening and said passage defined by upper and lower major surfaces of said housing and first and second sidewalls of said housing extending between said upper and lower major surfaces; and a dust gutter extending outwardly from said lower major surface at said first opening and at a downward incline with respect to said lower major surface so that said dust gutter lies below said lower major surface of said housing and dust on the fan blade falls away from said first opening into said dust gutter when the fan blade is moved in said first opening.

2. The cleaning tool of claim 1, wherein said housing includes opposing first and second inner surfaces defining said passage.

3. The cleaning tool of claim 2, further comprising first and second cleaning pads removably securable within said passage.

4. The cleaning tool of claim 3, wherein said first pad is adjacent said first inner surface, and said second pad is adjacent said second inner surface.

5. The cleaning tool of claim 4, wherein said first and second pads are deformably resilient and form a fit within said passage.

6. The cleaning tool of claim 5, wherein said first and second pads are foam.

7. The cleaning tool of claim 5, wherein said first and second pads include adjacent cleaning surfaces for simultaneously contacting opposing surfaces of the fan blade.

8. The cleaning tool of claim 5, wherein said first and second pads have substantially identical dimensions.

9. The cleaning tool of claim 5, wherein at least one of said first and second pads includes a beveled edge.

10. The cleaning tool of claim 9, wherein said beveled edge is adjacent said first opening.

11. The cleaning tool of claim 3, wherein said pads are moistened with a polishing fluid.

12. The cleaning tool of claim 3, wherein said upper and lower major surfaces respectively comprise a first major planar surface spaced from a second major planar surface, and said first and second sidewalls extend between and integral with said first and second major surfaces.

13. The cleaning tool of claim 12, wherein said dust gutter is integral with, said second major surface.

14. The cleaning tool of claim 12, further comprising a tubular member having a tubular member passage extending outwardly from said second major surface.

15. The cleaning tool of claim 14, wherein said tubular member passage extends substantially perpendicular to said second major surface.

16. The cleaning tool of claim 14, further comprising an elongate handle releasably securably within said tubular member passage.

17. The cleaning tool of claim 12, wherein said first and second major planar surfaces flare outwardly proximate said first opening.

18. The cleaning tool of claim 17, wherein said first opening is larger than said second opening.

19. The cleaning tool of claim 12, wherein at least one of said first and second major planar surfaces includes an indented portion relative to an edge defining said second opening.

20. The cleaning tool of claim 19, wherein said indented portion exposes a portion of an outer surface of said cleaning pad.

21. The cleaning tool of claim 12, wherein said dust gutter lies on a plane spaced from the plane of said second major planar surface.

22. The cleaning tool of claim 1, wherein said housing and said dust gutter are integrally formed of plastic.

23. The cleaning tool of claim 1, wherein said dust gutter includes a curved base.

24. A fan blade cleaning tool, comprising:

a housing having at least one opening and a passage extending from said at least one opening into said housing for receiving a fan blade;

first and second cleaning pads disposed inside said passage, said first and second cleaning pads having first and second planar cleaning surfaces, respectively, for contacting opposing sides of the fan blade when the fan blade is moved through said passage, and said first and second cleaning pads arranged such that said first and second planar cleaning surfaces form a planar interface between said first and second cleaning pads, said planar interface extending across at least a central portion of said passage and defining an area with substantially no gap between said first and second planar cleaning surfaces so that the fan blade deforms the first and second cleaning pads when inserted therebetween; and a dust gutter disposed adjacent to said at least one opening and extending outwardly therefrom so that force from said first and second cleaning pads removes dust from the fan blade and the removed dust falls into said dust gutter.

25. The fan blade cleaning tool of claim 24, wherein:

said first and second cleaning pads are substantially rectangularly shaped, and said interface extends across the entire width of said passage; and said dust gutter extends downwardly from said at least one opening so that said dust gutter lies below a bottom surface of said housing.

* * * * *